United States Patent [19]

Tice

[11] 4,270,474

[45] Jun. 2, 1981

[54] DUAL POSITION NEEDLE POSITIONER FOR STITCHING MACHINES

[76] Inventor: William A. Tice, 3620 N. Fountaincrest Dr., Knoxville, Tenn. 37918

[21] Appl. No.: 67,626

[22] Filed: Aug. 17, 1979

[51] Int. Cl.[3] ..... D05B 69/22

[52] U.S. Cl. ..... 112/276

[58] Field of Search ..... 112/220, 221, 67, 87, 112/276, 301, 274, DIG. 3

[56] References Cited

U.S. PATENT DOCUMENTS

| | | | |
|---|---|---|---|
| 3,298,341 | 1/1967 | Bonis | 112/276 |
| 3,528,379 | 9/1970 | Miller . | |
| 3,661,102 | 5/1972 | Tice | 112/276 |
| 3,924,553 | 12/1975 | Tice . | |
| 3,977,339 | 8/1976 | Tice . | |

*Primary Examiner*—Werner H. Schroeder
*Assistant Examiner*—Andrew M. Falik

[57] ABSTRACT

A needle positioner for a stitching machine for positioning of such needle selectively in an up or down position. The positioner is pneumatically powered and adapted to be installed on existing machines. The needle positioner functions to selectively position the needle in an up position or a down position. The stitching mechanism includes an air motor for reciprocating the drive shaft of the stitching mechanism. Two pneumatic cylinders are disposed proximate the drive shaft so that when the piston rods of the cylinders are extended, they contact the drive shaft and interrupt rotation of the drive shaft stopping the needle in an up position or a down position. The needle positioner also includes valves in the pneumatic circuit between a source of pressurized fluid and the pneumatic cylinders for directing the flow of air to a desired one of the two cylinders. The valves are operated by a pedal device which allows an operator of the stitching machine to activate the valves and select to stop the needle in its up or down position.

4 Claims, 5 Drawing Figures

DUAL POSITION NEEDLE POSITIONER FOR STITCHING MACHINES

This invention relates to control mechanisms for stitching machines and particularly to a system for selectively positioning the needle of a stitching machine at the close of a stitching operation in either the up or down position.

The present invention is principally intended for use with stitching machines in which the stitching mechanism is driven by an electric motor whose output shaft is operatively connectable or disconnectable with the stitching mechanism by means of a brake-clutch mechanism of the general type shown in U.S. Pat. No. 3,187,702, the pertinent parts of which are incorporated herein by reference. Such brake-clutch mechanisms are well known in the art.

In U.S. Pat. Nos. 3,924,553, "Needle Position Apparatus For Stitching Machines" and 3,977,339, "Pneumatic Needle Positioning Apparatus For Stitching Machines", both of which were invented by the present inventor, there is discussed the position of a needle of a stitching machine at the end of a stitching operation. Such patents disclose systems for positioning the needle of a stitching machine in either the up or down position. That is, the system of these patents may be mechanically altered to position the needle in the up position or to position the needle in the down position. There is no disclosure in either of these patents of a system which allows the operator to select whether the needle is positioned in the up or down position at the end of a stitching operation. These two patents in their entirely are incorporated herein by reference. The positioning of the needle in a high speed stitching machine is discussed in applicant's application entitled, "Needle Positioner for High Speed Stitching Machine" Ser. No. 067,702 filed contemporaneously herewith on Aug. 17, 1979 and such application is incorporated herein by reference.

The desirability of a system for selectively positioning the needle of a stitching machine in either the up or down position is portrayed by reference to a stitching operation such as sewing a shirt pocket onto a shirt in which the operator commences a stitching operation, sews a straight line for a predetermined distance, stops the machine, rotates the workpiece by approximately 90°, commences stitching again in a straight line for a specified distance, stops the machine, rotates the workpiece again, etc., until the perimeter of the pocket has been traversed by the stitching mechanism, whereupon the stitching mechanism is inactivated. When turning the workpiece, it is desired that the needle of the stitching mechanism be in the down position to serve as a pivot point for rotation of the workpiece and to prevent duplication or dropping of stitches upon recommencement of the stitching operation. When the entire perimeter of the pocket has been traversed with the stitching mechanism, it is desired that the needle be positioned in the up position for complete withdrawal of the workpiece from the stitching machine. Obviously, substantial time saving and resultant cost benefits are obtainable if the operator is capable of selectively positioning the needle in the down position when desired, and in the up position when desired. Especially, it is desired that the operator be able to randomly select the position of the needle at the end of a stitching operation, i.e., when the stitching mechanism is inactivated.

Heretofore, certain needle positioning mechanisms which provide to the operator the capability of selecting the position of the needle when the stitching mechanism is inactivated have been electrically operated. It is well recognized in the art that such mechanisms are costly to manufacture and are subject to excessive maintenance and down time. Insofar as is known to the present inventor, no pneumatically powered, dual position needle positioner for stitching machines heretofore existed.

One of the principal obstacles to the use of pneumatically-powered systems for accomplishing dual-position needle positioning heretofore has been the problem of how to provide for braking of the stitching mechanism when it is deactivated to quickly stop such mechanism, and quickly thereafter to release such brake to the limited extent that the stitching mechanism is free to be repositioned, but not to the extent that the clutch of the stitching machine is engaged. Of course, such actions, and non-actions, must be performed by an operator whose job performance and compensation is highly dependent upon her production rate so that the needle positioning operation must consume a minimum amount of her time and thought. It is important, therefore, that there be no, or insubstantial, change in the "feel" of operation of the foot pedal of the stitching machine to the operator, nor can there be any substantial decrease in the speed at which the operator can move the foot pedal. For example, it is common for an operator at the end of a stitching operation to quickly release the pressure of her toe against the foot pedal and simultaneously to heel back on the pedal, all in a fast, continuous motion.

In accordance with the present invention, there is provided a needle positioner for a stitching machine for positioning the needle of such machine selectively in an up or down position. The positioner of the present invention is pneumatically powered and adapted to be installed on existing machines. Stated briefly, the present invention includes at least two needle positioning subassemblies of the type disclosed in U.S. Pat. No. 3,977,339, one of which is adjusted to position the needle in its down position and the other of which is adjusted to position the needle in its up position. Control over the admission of pressurized fluid, usually air, to these subassemblies is by means of a novel pitman assembly which is connected between the foot pedal and the lever arm which operates the brake-clutch mechanism. Such pitman assembly comprises first and second pitman rods for controlling the flow of pressurized fluid to the needle positioning subassemblies and to a piston-cylinder means which is also operatively associated with the rods to selectively position the lever arm for selective actuation and deactuation of the brake-clutch mechanism in response to given pedal positions.

It is therefore an object of this invention to provide a needle positioning system for selectively positioning the needle of the stitching machine in an up or down position. It is another object of this invention to provide a pneumatically powered, dual position, needle positioner for a stitching machine. Other objects and advantages of this invention will be apparent from the following description including the claims and drawings in which:

Figures 1, 2:
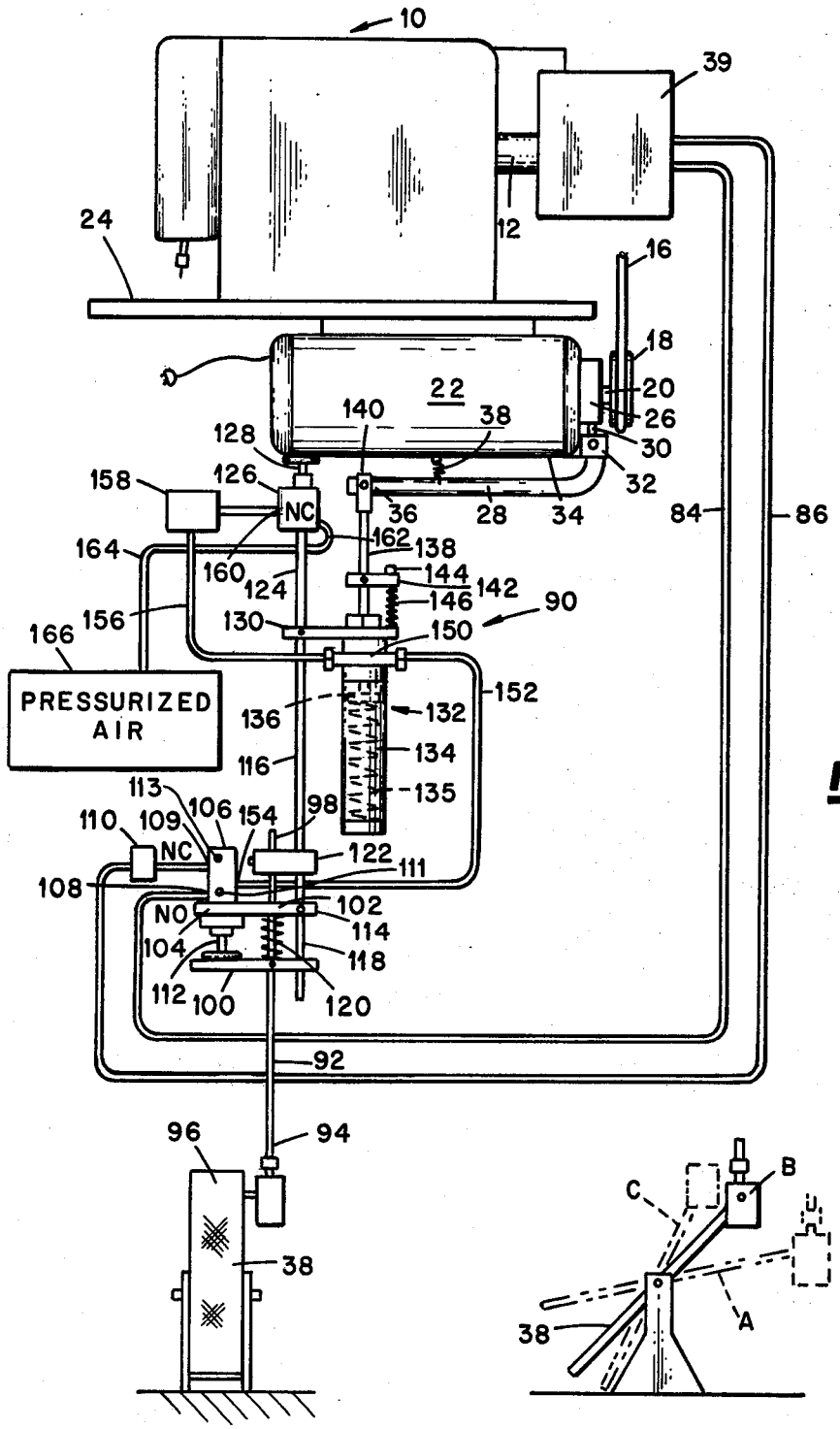
FIG. 1 is a schematic representation of a needle positioner embodying various features of the invention.
FIG. 2 is a representation of a foot pedal, in side view, showing various positions of the foot pedal as employed in conjunction with the present invention.

With reference to FIG. 1, there is shown a stitching machine 10 including a stitching mechanism comprising a first shaft 12 having mounted thereon a first pulley 14 which is operatively connected by means of a belt 16 to a pulley 18 mounted on the drive shaft 20 of an electric motor 22. In the depicted embodiment, the motor is mounted on the bottom surface of a work table 24. The motor 22 is provided with a conventional brake-clutch mechanism of a type which is well-known in the art and a typical one of which is described in U.S. Pat. No. 3,187,702. In the depicted embodiment, the brake-clutch mechanism is operated by means of a lever arm 28, one end 30 of which is pivotably mounted by means of a bracket 32 to the motor housing 34 and which extends at right angles back under the motor 22 to provide a cantilevered outboard end 36. In the depicted brake-clutch mechanism, the drive shaft 20 of the motor 22 is braked when the lever arm 28 is in its upward position. A spring 38 urges the outboard end 36 of the lever arm toward the motor housing 34. Accordingly, there is required a downward pull upon the lever arm 28 to disengage the brake and to engage the clutch mechanism to connect the drive shaft 20 with the motor 22 and commence a stitching operation. This action is commonly obtained by the operator pressing down on the top of a foot pedal 38 with her toes to move the pedal to Position A as shown in FIG. 2. Upon completion of a stitching operation movement of the lever arm 28 to its most upward position results in disengagement of the clutch and application of the brake to the drive shaft 20 and resultant stopping of the stitching mechanism. This action occurs when the operator returns the foot pedal 38 to its neutral Position B as shown in FIG. 2. As will be described hereinafter, return of the foot pedal to the neutral position serves further functions including the positioning of the needle in its down position. Positioning of the needle in its up position occurs when the operator heels back on the foot pedal, Position C, as shown in FIG. 2.

Figure 4:
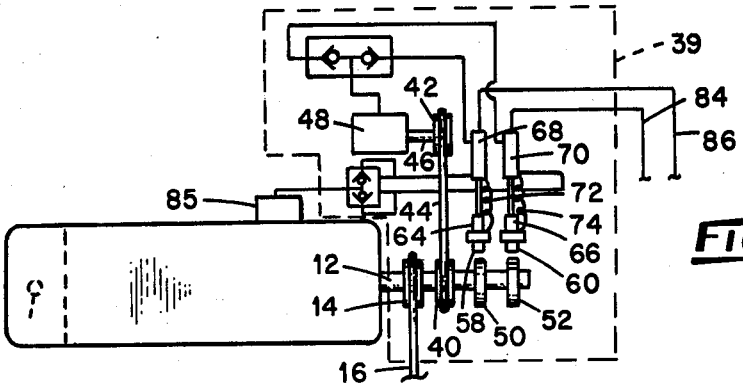
FIG. 4 is a top view of the representation of FIG. 3.
Figure 3:
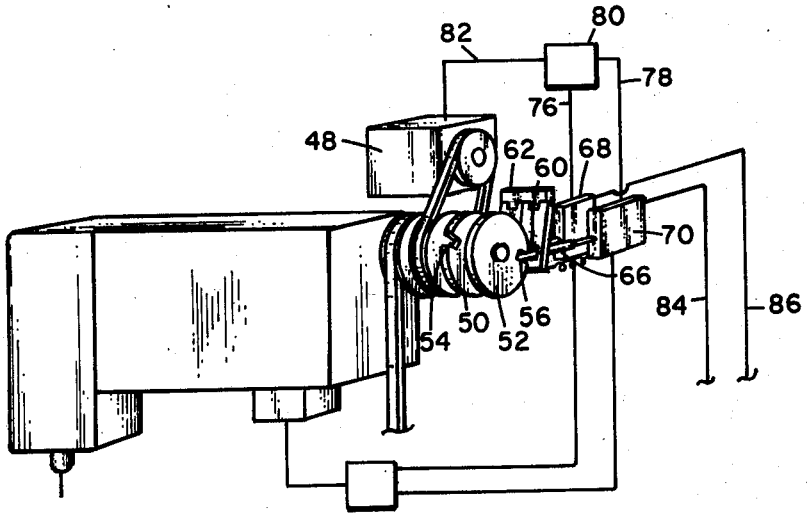
FIG. 3 is a representation of a portion of the present system associated with the drive shaft of the stitching mechanism of a stitching machine.

With reference to FIGS. 3 and 4, the shaft 12 of the stitching mechanism has associated therewith a needle positioning subassembly 39 that includes a pulley 40 mounted on the shaft 12 and which incorporates therein an overriding clutch assembly of the conventional type by means of which the pulley 40 is caused to remain stationary when the shaft 12 is rotated but which imparts a driving rotational force to the shaft 12 when the pulley 40 itself is rotated. This pulley 40 is connected in driven relation to a further pulley 42 by means of a belt 44. The pulley 42 is mounted on the drive shaft 46 of a pneumatically powered motor 48 (an air motor).

The shaft 12 further has mounted thereon first and second cams 50 and 52, respectively. These cams are fixed to the shaft 12 and rotate therewith. Further, the periphery of the cam 50 defines a cam surface in which there is provided a recess 54. A like recess 56 is provided in the periphery of the cam 52. Detent means 58 and 60 are hingedly mounted on a bracket 62 adjacent the cams 50 and 52 for independent movement. As thus disposed, the detents 58 and 60 are in position for engaging the recesses 54 and 56, respectively, of the cams 50 and 52 when urged toward such cams and when the appropriate recess is in register with a detent. Movement of the detent toward the cam is accomplished by means of piston members 64 and 66 of respective piston-cylinder members 68 and 70. Spring means 72 and 74 provide for biased positioning of the detent out of contact with their respective cam peripheries. A detailed description of the piston-cylinder members 68 and 70 and their operation is found in U.S. Pat. No. 3,977,339 and need not be repeated herein. In the present system, however, the recess in one of the cams is angularly oriented with respect to the drive shaft 12 such that when this recess is in register with its respective detent, the needle is in its down position. Further, the recess in the other of the cams is angularly oriented with respect to the drive shaft 12 such that when such recess is in register with its respective detent, the needle is in its up position.

Referring again to FIGS. 3 and 4, the piston-cylinder members 68 and 70 are each connected by respective conduit means 76 and 78 to a shuttle valve 80 which functions to limit the passage of pressurized fluid therethrough to fluid flowing from either conduit 76 or conduit 78. Further, the shuttle valve prevents backflow of pressurized fluid therethrough. This shuttle valve 80 is connected in fluid communication with the air motor 48 by conduit means 82 whereby the flow of pressurized fluid from either of the piston-cylinder devices 68 or 70 functions to activate and drive the air motor 48, hence to rotate the pulley 40 and, as a consequence, rotate the shaft 12. Pressurized fluid is supplied to the piston-cylinder devices 68 and 70 by means of conduits 84 and 86, respectively, for operation of the same.

In one embodiment, the stitching machine is provided with a pneumatically powered mechanism 85 for lifting the presser foot of the machine. In the depicted embodiment, this mechanism 85 is connected through a shuttle valve 87 to the piston-cylinder members 68 and 70 so that when either of such piston-cylinder devices is actuated, pressurized fluid flows to the foot lift mechanism to operate the same.

In accordance with the present invention, there is provided between the foot pedal 38 and the lever arm 28 which operates the brake-clutch mechanism of the drive motor 22, a pitman assembly through which the motions of the operator in moving the foot pedal 38 are converted to control motions for operating the stitching mechanism and for positioning of the needle of the stitching mechanism in either its up or down position as selected by the operator. This pitman assembly, designated generally by the numeral 90, comprises a first pitman rod 92 one end 94 of which is pivotally connected to the outboard end 96 of the foot pedal 38 so that the rod 92 moves along a generally up and down reciprocatory path as the pedal is operated by an operator. The outboard end 98 of the rod 92, in the depicted embodiment, has adjustably secured thereto a first bracket 100 which extends in cantilevered fashion therefrom in a generally normal direction. Further, there is slidably received on the end 98 of the rod 92, and above the bracket 100, a further bracket 102 which extends normally from the rod 92 and substantially parallel to the bracket 100 to receive in its outboard end 104 a valve 106. The opposite end 114 of the bracket 102 is adjustably secured to a further pitman rod 116.

The valve 106 in one embodiment is a model TAC 4P valve from Humphrey Products, Kalamazoo, Mich., and is provided with a first exit port 108 to which there is connected a conduit 84 for supplying pressurized fluid to the piston-cylinder member 70. This exit port 108 is normally open. The valve is further provided with a second exit port 109 which is normally closed and which is connected by conduit 86 in fluid communication with the piston-cylinder member 68. Exhausts 111 and 113 are provided in association with the exit ports 108 and 109 for exhausting fluid pressure downstream of a respective port when such port is closed. As desired, a quick exhaust valve 110 may be interposed in the conduit 86. The valve 106 is further provided with a stem 112 which is disposed adjacent the upper surface of the bracket 100 and which, when moved between extended and retracted positions, functions to move the spool of the valve 106 to selectively open or close the exit ports thereof. It will be recognized that the physical arrangement of the valve 106 in the pitman assembly can be changed without changing its function. For example, the valve and its mounting may be inverted with slight modification without changing the functioning thereof.

The pitman assembly 90 further includes a second rod 116 whose lower end 118 has adjustably secured thereto the end 114 of the bracket 102 so that the valve 106 is rigid with respect to the rod 116. A coil spring 120 is provided in encircling relationship with the rod 92 in the space between the brackets 100 and 102 to bias these brackets apart from one another. This action further biases the valve 106 toward a position in which its stem 112 is extended and the spool of the valve is positioned such that exit port 108 is open and exit port 109 is closed. The outboard end 98 of the rod 92 has further adjustably secured thereto a block 122. This block extends laterally from the rod 92 to slidably receive therethrough the pitman rod 116. It will be noted that when the rod 92 is moved downwardly, the block 122 will contact the bracket 102 so that further downward movement of the rod 92 causes simultaneous downward movement of the rod 116.

The upper end 124 of the pitman rod 116 serves to mount a normally closed 3-way valve 126 such as a Model MJV-3 valve from Clippard Valve Co., Cincinnati, Ohio, which includes a stem 128 whose function is to open the valve 126 when the stem is retracted and to close the valve 126 when the stem is extended. In its extended position, the stem exposes an exhaust (not shown in the depicted embodiment) which exhausts the pressure downstream of the valve 126. As depicted, by reason of the physical location of the valve 126 as determined by the pitman rod 116 and its movements, the stem 128 of the valve 126 is selectively caused to bear against the housing of the motor 22 or some other non-yielding surface. As noted, this action serves to open or close the valve 126.

There is further provided along the length of the rod 116, a mounting bracket 130 that is adjustably secured to the rod 116 and movable therewith. This mounting bracket extends laterally from the rod 116 and serves to mount one end of a piston-cylinder device 132. This piston-cylinder device comprises a cylinder 134 which has slidably contained therein a piston 136 to which there is secured a piston rod 138 which extends out of the cylinder 134 and has its outboard end pivotably mounted as by a clevis 140, to the outboard end 36 of the lever arm 28. The piston rod 138 is biased toward an extended position by spring means 135 contained within the cylinder 134 and which acts upon the piston 136. When the piston 136 is actuated to retract the piston rod 138 into the cylinder 134, there is a resulting downward movement on the lever arm 28. A stop 142 is adjustably secured to the piston rod 138 and serves to provide an adjustable limit to the retraction of the piston rod 138 into the cylinder 134. This stop 142 slidably receives therethrough a guide pin 144 whose lower end is secured to the bracket 130. This guide pin provides for alignment of the piston rod 138 as it moves in and out of the cylinder 134. Further, a coil spring 146 is provided between the stop 142 and the bracket 130 to aid in the alignment function and to bias the stop toward an extended position of the piston rod. The cylinder 134 is provided with a tee 150 which provides for the introduction of pressurized fluid to the cylinder 134 and which is in turn connected at one of its ports to a conduit 152 to provide fluid communication between the tee and the inlet port 154 of the valve 106. The other port of the tee is connected by a conduit 156 through a flow delay 158 to the exit port 160 of the valve 126. The inlet port 162 of the valve 126 is connected by conduit 164 to a source of pressurized air 166.

Figure 5:
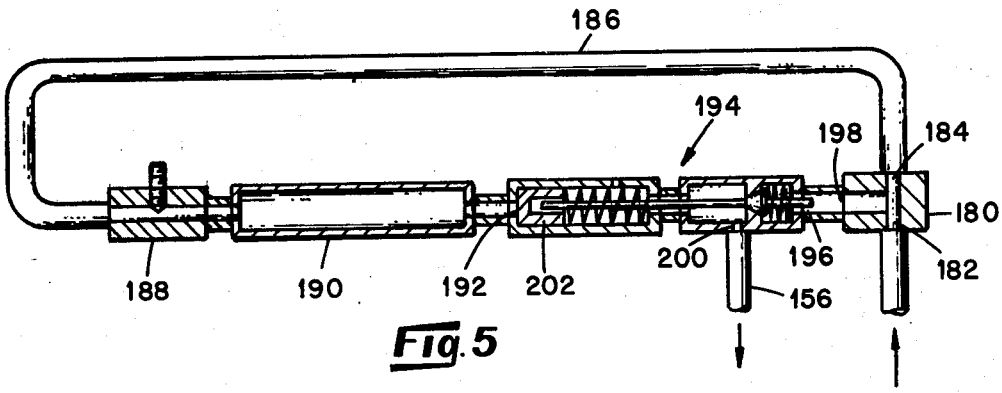
FIG. 5 is a representation, partly in section, of a flow delay device employed in the present system.

As depicted in FIG. 5, a flow delay mechanism 158 is interposed between the valve 126 and the tee 150. The depicted flow delay comprises a tee 180 having its inlet port 182 connected in fluid communication with the valve 126. One outlet port 184 of the tee 180 is connected by means of a conduit 186, an adjustable orifice 188, and a chamber 190 to one inlet 192 of a pilot actuated valve 194 of conventional design. A second inlet 196 of the valve 194 is connected in fluid communication with an outlet 198 of the tee 180. The valve 194 is normally closed against the flow of pressurized fluid from the tee 180 to the outlet 200 of the valve. However, when such fluid flows through the conduit 186, the orifice 188, and the chamber 190, it acts upon a plug 202 in the valve assembly 194 to open the valve and permit the flow of fluid directly from the tee 180 and out through the valve 194 to the conduit 156.

In a typical operation employing the present system, the operator controls the stitching operation and the position of the needle of the stitching machine by means of the foot pedal 38. When it is desired to commence a stitching operation, the operator moves the foot pedal toward its "operating" position as shown in phantom in FIG. 2 and identified by the letter A. This action initially exerts a downward movement on the first rod member 92 of the pitman rod assembly thereby closing the exit port 109 of the valve 106 and opening the exit port 108 of such valve. Pressurized air downstream of the valve 106 is exhausted through exhaust ports which are built into the valve. Preferably, additional exhaust capacity is provided by the quick exhaust valve 110 to reduce the "back pressure" on the foot pedal. As the first rod 92 of the pitman assembly moves downwardly in response to the movement of the foot pedal, the bracket 122 affixed to the upper end of the first rod 92 is moved downwardly into contact with the bracket 102 which is fixed to the second rod 116 of the pitman rod assembly to cause this second rod to move downwardly simultaneously with further downward movement of the first rod. Such downward movement of the second rod 116 moves the valve 126 away from the motor 22 to permit the stem 128 of the valve 126 to extend fully thereby closing the valve 126. This action shuts off pressurized air from the cylinder 134 and from the valve 106 thereby rendering the piston-cylinder device 132 and the needle positioning mechanisms 68 and 70 inoperative. This downward movement of the rod 92 further moves the piston-cylinder device 132 downwardly until the piston rod 138 contained therein is fully extended. Further downward movement of the piston-cylinder device 132 exerts a downward force upon the lever arm 28 to engage the clutch mechanism and commence a stitching operation. Upon completion of the stitching operation, the operator returns the foot pedal to its neutral position if she wishes to stop the needle in its down position. As desired, the operator can move the foot pedal through its neutral position to its "heeled back" position so that the needle is stopped in its up position. When the operator returns the foot pedal 38 to its neutral position, the upward thrust on the pitman assembly urges the valve 126 toward the motor 22 such that the stem 128 of this valve is depressed into the valve to open this valve and introduce pressurized fluid to the flow delay 158. Simultaneously, such upward movement of the pitman assembly releases the lever arm 28 to move upward and disengage the clutch and engage the brake. The depression of the stem 128 into the valve 126 opens this valve and permits the flow of pressurized fluid through the flow delay 158 to the cylinder 134. Within the cylinder, the pressurized fluid acts against the piston 136 to withdraw the piston rod 138 into the cylinder 134 until the stop 142 contacts the top of the cylinder and halts the withdrawal. This limited withdrawal of the piston rod 138 exerts a downward force upon the lever arm 28 sufficient to release the brake mechanism, but which is not sufficient to permit engagement of the clutch mechanism, nor which is sufficient to permit the valve 126 to move away from the motor housing to an extent which will result in closing of such valve. Thus, pressurized fluid continues to flow to the cylinder 134. To ensure that the brake is applied for a time sufficient to stop the stitching mechanism, the flow delay 158 retards the flow of pressurized fluid to the cylinder 134 for a time that is adjustable but which is sufficient to allow completion of the braking operation before the piston rod 138 is withdrawn into the cylinder 134 to release the brake and allow further and subsequent rotation of the shaft 12 for positioning of the stitching needle. The time duration of such delay is specific for each machine in that it is dependent upon the braking speed of the machine which in turn is dependent upon many variables. As noted hereinbefore, the withdrawal of the piston rod 138 into the cylinder 134 functions to release the brake. By means of the adjustable stop 142, such withdrawal is limited to only that which will release the brake without engaging the clutch to start a stitching operation. This adjustability, among other features, permits the present system to be installed on existing stitching machines each of which may require more or less movement of the lever arm 28 to effect brake release, etc.

Simultaneously with the flow of fluid to the cylinder 134, such fluid flows to the inlet port 154 of the valve 106. Inasmuch as this valve has a normally open exit port 108, the fluid flow continues through the valve and out the exit port 108 to the needle positioning piston-cylinder member 68 to actuate the same and the motor 48 to position the needle in the "down" position. Thus, when the foot pedal is in its neutral position, the needle is positioned, i.e., stopped, in its down position. It is to be noted that the limitations placed upon the movements of the lever arm 28, the piston rod 138, the valve 126, and other components of the present system are important to the successful operation of the present system. For example, if the lever arm 28 is allowed to move too far when air is admitted to the cylinder 134, the machine will commence stitching, when in fact it is desired that the machine be stopped.

If the operator desires that the needle be positioned in its "up" position, he or she heels back on the pedal 38 to position the pedal as shown in FIG. 2 and identified by the letter C. This action of the operator imparts an upward movement to the first rod 92 of the pitman assembly 90 which in turn moves the bracket member 100 upwardly into contact with the stem 112 of the valve 106 causing this stem to be depressed and thereby shift the spool within the valve to a position whereby the normally closed exit port 109 thereof is opened and the normally open exit port 108 thereof is closed. This action permits the flow of pressurized air through the valve 106 and out the normally closed exit port 109 through the conduit 86 to the needle positioning piston-cylinder member 70. Because the valve 106 is mounted on a bracket member 104 which is slidable with respect to the first rod member 92, but which is fixed to the second rod member 116, the heeling back on the pedal by the operator has no effect upon any of the elements of the control system which are associated with and/or are attached to the upper rod 116 of the pitman rod assembly.

Additional adjustability of the pitman assembly, both in the relationship of the several components thereof and in the relationship of the assembly to the motor 22 and the foot pedal 38, is provided by the adjustable mounting of the brackets 100, 102, 122 and 130 to the pitman rods 92 and 116. The present system, therefore, is suitable for use on different types and/or models of stitching machines, can accommodate various spacings between the foot pedal and the motor or lever arm, etc.

Whereas there is depicted and described a specific embodiment of the present invention, it is intended that the invention be limited only as set forth in the appended claims.

What is claimed:

1. A pneumatic powered dual position needle positioner for a stitching machine including pedal means, a stitching mechanism comprising a reciprocatable needle and a drive shaft, comprising air motor means drivingly connected to said drive shaft of said stitching mechanism for rotation of said drive shaft upon actuation of said motor means, a source of pressurized fluid, means connecting said source of pressurized fluid to said air motor means, means selectively restraining rotation of said shaft means away from preselected rotation positions of said shaft, said last mentioned means including a least first and second piston-cylinder means each of which is interposed between said source of pressurized fluid and said air motor means and each of which is disposed adjacent to said drive shaft and each piston of which includes a portion exposed externally of said cylinder whereby movement of said piston within said cylinder in response to the admission of pressurized fluid into said cylinder functions to establish a limit to rotation of said drive shaft, valve means interposed between said source of pressurized fluid and said cylinder means, said valve means including an inlet port and first and second outlet ports, said inlet port being connected in fluid communication with said source of pressurized fluid and said outlet ports being connected in fluid communication with respective ones of said piston-cylinder means for selectively directing the flow of pressurized fluid to a respective one of said cylinder means, and means operatively connected between said pedal means and said valve means comprising a pitman assembly including a first pitman rod connected at one of its ends to said pedal means and at its other end operatively engageable with said valve means whereby selection of the position of said pedal determines the flow of pressurized fluid to said cylinders.

2. In combination with a stitching machine of the type wherein the stitching mechanism thereof comprises a needle mounted for movement along a reciprocatory path, a drive shaft connected to said needle for moving said needle along said path, motor means, a brake and clutch mechanism for selectively connecting said motor means to said drive shaft, lever arm means adapted to control the engagement and disengagement of said brake and clutch mechanism, and foot pedal means, a pneumatically powered system for selectively positioning said needle in an up or down position comprising pulley means mounted on said drive shaft, pneumatically powered motor means, means connecting said pneumatically powered motor means in driving relationship to said pulley means, said pulley means including means providing for free rotation of said drive shaft within said pulley when said pneumatically powered motor means is inactive and for driving engagement of said pulley means to said drive shaft when said pneumatically powered motor means is activated, first and second cam means mounted on said drive shaft and rotatable therewith, each of said cam means defining a cam surface having a recess therein, first and second detent means disposed in juxtaposition to respective ones of said first and second cam means, means mounting each of said detent means for movement between positions of engagement and disengagement with its respective recess independently of the other detent means, said recess in said first cam means being angularly oriented with respect to said drive shaft means such that when said drive shaft means is rotated to a position wherein said needle is in its down position said recess in said first cam means is in register with its respective detent means, said recess in said second cam means being angularly oriented with respect to said drive shaft means such that when said drive shaft means is rotated to a position wherein said needle is in its up position said recess in said second cam means is in register with its respective detent means, first and second piston-cylinder means each of which includes a piston member that is reciprocatably mounted within a respective cylinder in response to the introduction of pressurized fluid to such cylinder and which includes a piston rod means that projects externally of such cylinder in position to contact a respective detent means to urge the same into engagement with its respective cam recess when said piston rod means is extended from said cylinder in response to the admission of pressurized fluid thereto, first and second conduit means connecting each of said first and second cylinders in fluid communication with said pneumatically powered motor means, a pitman assembly including first and second pitman rods interposed in operative relationship between said pedal means and said lever arm means, said pitman assembly including first valve means having an inlet port, first and second outlet ports, and stem means extending externally of said first valve means and adapted to selectively open and close said exit ports, one of said exit ports being normally open and the other being normally closed, third and fourth conduit means connecting said first and second exit ports in fluid communication with respective ones of said first and second piston-cylinder means, a source of pressurized fluid, fifth conduit means connecting said source of pressurized fluid in fluid communication with said inlet port of said first valve means, second valve means interposed in said fifth conduit means between said source of pressurized fluid and said first valve means, said second valve means including stem means extending externally thereof and adapted to move between extended and retracted positions to open and close said second valve means, said second valve means being mounted on one of said pitman rods in juxtaposition to a nonyielding surface whereby preselected movement of said valve with said pitman rod moves said stem relative to said nonyielding surface to open or close said valve, third piston-cylinder means mounted on one of said pitman rods for movement therewith, said piston-cylinder means including a piston rod extending therefrom and operatively engaging said lever arm means, and means connecting said piston-cylinder means in fluid communication with said fifth conduit means downstream of said second valve means whereby when pressurized fluid is admitted to said piston-cylinder means said piston rod thereof is actuated to move said lever arm to a position wherein said brake and said clutch are disengaged and said drive shaft is rotatable by said pneumatically powered motor means.

3. The combination of claim 2 and including a fluid flow delay means interposed between said second valve means and said third piston-cylinder means.

4. In combination with a stitching machine of the type wherein the stitching mechanism thereof includes a needle, a drive shaft for moving said needle along a reciprocatory path and which is drivingly connected to a power source by means of a brake-clutch mechanism that is controlled through a lever arm or like mechanism, a pedal means, a pneumatically-powered system for selectively positioning the needle of such machine in an up or down position upon the completion of a stitching operation comprising pulley means mounted on said drive shaft, pneumatic motor means, means connecting said first pulley, means in driven relationship with said pneumatic motor means for rotation of said pulley means and said drive shaft when said motor means is actuated, first and second cam means mounted on said drive shaft for rotation therewith, means defining a recess in each of said cam means, a source of pressurized fluid, means connecting said source of pressurized fluid to said pneumatic motor means, control means interposed between said source of pressurized fluid and said pneumatic motor means, said control means comprising first and second cylinder means each having a bore extending therethrough, piston means movably disposed in each of said bores and each having a portion thereof exposed externally of said cylinder, first and second detent means each of which is suitable for engagement in a recess in one of said cam means, said exposed portion of one of said piston means being operatively associated with one of said detent means whereby movement of said piston within its respective cylinder in response to the admission of pressurized fluid to said cylinder causes said associated detent to be urged toward engagement of said detent in a respective recess in one of said cam means to restrain said cam means and said drive shaft against rotation thereof, each of said recesses being angularly oriented with respect to said shaft means to define a preselected position of said needle within its reciprocatory path, said control means further including valve means interposed between said first and second cylinder means and said source of pressurized fluid and including an inlet port and first and second outlet ports, said inlet port being connected in fluid communication with said source of pressurized fluid and said outlet ports being connected in fluid communication with respective ones of said cylinder means for selectively directing pressurized fluid to said first and second cylinder means, and means operatively connected between said pedal and said valve means comprising a pitman assembly including a first pitman rod connected at one of its ends to said pedal means and at its other end operatively engageable with said valve means whereby selected positioning of said pedal means provides selected operation of said valve means.

* * * * *